US006170112B1

(12) United States Patent
Mayfield et al.

(10) Patent No.: US 6,170,112 B1
(45) Date of Patent: Jan. 9, 2001

(54) PUSH BROOM WITH BOWED HANDLE

(76) Inventors: Roy Mayfield; Vanessa Mayfield, both of 415 South Lewis Ct., Claremont, CA (US) 91711

( * ) Notice: Under 35 U.S.C. 154(b), the term of this patent shall be extended for 0 days.

(21) Appl. No.: 09/197,306

(22) Filed: Oct. 2, 1998

(51) Int. Cl.[7] ..... A46B 15/00; B25G 1/10

(52) U.S. Cl. ..... 15/159.1; 15/143.1; 15/144.4; 16/429; 16/430; 16/436; 37/285; 56/400.17; 294/57; D32/50; D32/51

(58) Field of Search ..... 15/143.1, 144.1–144.4, 15/145, 159.1; 16/429, 430, 436; 37/285; 56/400.01, 400.17; 294/57

(56) References Cited

U.S. PATENT DOCUMENTS 2,753,579 * 7/1956 Kussmann ..... 15/145
3,222,699 * 12/1965 Zeisig ..... 294/57 X
3,474,481 * 10/1969 Soleymani et al. ..... 15/143.1 X
4,809,388 * 3/1989 Dietrich ..... 16/430 X
4,865,373 * 9/1989 Hudson ..... 37/285 X
5,060,343 * 10/1991 Nisenbaum ..... 16/430 X
5,159,769 * 11/1992 Odorisio ..... 294/57 X
5,165,144 * 11/1992 Nisenbaum ..... 16/430 X
5,791,006 * 6/1998 Anctil ..... 15/144.4

FOREIGN PATENT DOCUMENTS

661334 * 3/1965 (BE) ..... 294/57
619051 * 3/1927 (FR) ..... 15/144.4

* cited by examiner

*Primary Examiner*—Mark Spisich
(74) *Attorney, Agent, or Firm*—William L. Chapin

(57) ABSTRACT

A push broom operable by a person in a more comfortably upright stature and with less force than required in using straight-handled push brooms has a front handle portion which extends conventionally upwardly and rearwardly from a brush block having downwardly depending bristles. The handle includes a posterior portion which angles upwardly and rearwardly from the front handle portion, thereby orienting the rear, upper end of the posterior handle portion is in a more nearly vertical position than that of straight handled brooms. Preferably, the handle is doubly bowed, the posterior portion of the handle including an intermediate handle portion inclined upwardly and rearwardly from the front handle portion, and a rear handle portion inclined upwardly and rearwardly from the intermediate handle portion.

13 Claims, 4 Drawing Sheets

10
14

PUSH BROOM WITH BOWED HANDLE

BACKGROUND OF THE INVENTION

A. Field of the Invention

The present invention relates to long-handled tools such as rakes, hoes, push brooms and the like, which are of the type generally used by persons in a standing position. More particularly, the invention relates to an improved push broom construction which utilizes a bowed handle to improve the ease of use and efficiency of the broom.

B. Description of Background Art

Long-handled tools such as rakes, hoes, shovels and the like are used routinely by people throughout the world in numbers too large to readily quantify. Such tools are used by farmers, gardeners, and homeowners, as well as other individuals. Included in the list of long-handled tools in widespread use is the ubiquitous push broom used by janitors and maintenance personnel to sweep floors, roadways and the like clean of dirt or debris. The construction of push brooms has remained little changed throughout the years, consisting essentially of a laterally elongated rectangular plan-view brush block having downward depending bristles, and a long straight handle which lies in a vertical plane perpendicular to the brush block. Most push brooms are constructed so that the handle is angled backwards from a vertical normal to the brush block and the horizontal footprint of the bristles in contact with a swept surface. With this construction, the handle may be more readily grasped and pushed forward or pulled rearward by the user to sweep a surface. However, even with the handle angled upwards and rearwards from the brush block, the thrust force exerted on the end of the handle grasped by the user is resolved into a substantially large component in the vertical direction, pushing down the tips of bristles against the swept surface. For example, with the longitudinal axis of the handle angled rearward 45 degrees from a vertical line through the brush block, thrust force exerted on the end of the broom handle by the user is resolved into equal horizontal and vertical reaction force vectors, equal to the thrust force multiplied by the sine and cosine of the inclination angle of the handle, respectively. Even for a more typical handle inclination angle of about 60 degrees, the vertical force exerted by the bristles on a swept surface is still half as large (cosine of 60 degrees) as the thrust force exerted on the handle by the user.

As a result of the substantial downward force exerted on a swept surface by the bristles of push brooms of prior art design and construction, substantial frictional forces, resist horizontal motion of the broom. This force is equal to product of the vertically downward component of the thrust force and the coefficient of friction between the bristle tips and the swept surface. The work required by the broom user to overcome the frictional reaction force is essentially wasted energy, since the purpose of sweeping with the broom is to move dirt with a minimum amount of force. As a result, push brooms of prior art design are difficult to use effectively by people with reduced strength, including women, children, and people with physical handicaps. Moreover, prolonged use of prior art push brooms, even by able-bodied persons, can cause muscle fatigue. For example, use of push brooms with a conventionally angled handle often requires that the user assume a somewhat stooped posture, to keep the bristles in flat contact with a swept surface, and/or to insert the broom head under obstructions. The stooped posture can cause back pain, and prolonged use of a push broom in this position can result in chronic back problems.

In apparent recognition of some of problems experienced in using conventional push brooms, Johnson, U.S. Pat. No. 4,958,407, discloses an Auxiliary Tool Handle comprising one or more looped auxiliary handles attachable to the straight handle of a push broom or a garden tool such as a rake, shovel, hoe or the like. The primary stated purposes of the auxiliary handle is to allow fingers of the user to grasp a portion of the auxiliary handle and exert forces directed substantially parallel to the fingers, rather than a slide-resisting force required when grasping a straight tool handle, which can cause fatigue and blisters. Since the curvilinear surface of the auxiliary handle curves away from the straight handle of a tool to which it is attached, it is possible to change one's grip and thereby lower the handle without bending over, to rake leaves under a bush, for example.

Hauser et al., U.S. Pat. No. 5,133,101, Jul. 28, 1992, discloses a mop handle having a cushioned end and opposed cushioned parallel side handles to reduce user strain.

Berti, U.S. Pat. No. 5,010,616, discloses a sweep broom with a handle slanted in the plane of the bristle block.

Other prior references known to the present inventors which relate generally to brooms consist of the following U.S. Patents: Bryant, U.S Pat. No. D321,793, Push Broom, Geffers, U.S. Pat. No. 3,891,339, Push Broom Handle Clamp, and Lammert et al., U.S. Pat. No. 4,538,318, Push Broom Assembly.

None of the prior art related to push brooms known to the present inventors is effective in reducing problems caused by the stooped postures required in using conventional push brooms having straight handles. The present invention addresses those problems.

OBJECTS OF THE INVENTION

An object of the present invention is to provide an improved push broom comprising a laterally disposed brush block having downwardly depending bristles and a handle that lies in a vertical plane and bows rearwardly and upwardly from the brush block.

Another object of the invention is to provide a push broom having an upwardly bowed handle.

Another object of the invention is to provide a push broom fitted with a handle having a short straight front section angled upwardly and rearwardly from a laterally disposed brush block, and a longer section bowed upwardly and rearwardly from the front handle section.

Another object of the invention is to provide a push broom fitted with a handle having a short straight front section angled upwardly and rearwardly from a brush block, an intermediate section bowed upwardly and rearwardly from the front handle section, and a rear handle section angled upwardly and rearwardly from the intermediate handle section.

Another object of the invention is to provide an improved handle for tools of the type having a front working portion for contacting earth, floors or other ground surfaces, and an upwardly depending handle section adapted for grasping by a standing person, the improved handle comprising a front elongated section for attachment to the working portion of a tool in an upwardly and rearwardly angled disposition therefrom, and a rear handle section bowed upwards from the front handle section.

Another object of the invention is to provide an improved tool handle comprising a front elongated handle section for attachment to the working portion of the tool, an intermediate elongated handle section bowed upwardly and rearwardly from the front handle section, and a rear handle section angled upwardly and rearwardly from the intermediate handle section.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends a push broom of novel design and construction, which may be operated by a person in a more upright stature and with less force than required in using prior art push brooms.

According to the present invention, a push broom is provided which has a laterally disposed brush block having downwardly depending rows of flexible brush bristles suited to sweeping dirt and debris on a surface contacted by the bristles. The push broom according to the present invention includes an elongated handle which may be of generally uniform cross sectional shape which is attached to the upper side of the brush block. The handle of the push broom preferably lies in a vertical longitudinal medial plane which is perpendicular to the brush block, the handle having a front portion angled upwardly and rearwardly from the brush block. According to the present invention, the rear portion of the handle bows upwardly, thus positioning the rear portion of the handle located further from the bristle block in a more nearly vertical position relative to the bottom horizontal footprint of the brush bristles than pre-existing brushes. Thus oriented, the handle of the push broom may more conveniently be grasped and thrust forward by a person using the broom. In the preferred embodiment, the handle has a relatively short, straight front section which is angled upwardly and rearwardly from the upper side of the brush block and a relatively longer posterior handle section which is bowed upwardly from the front handle section. Preferably, the handle, according to the present invention, is of a doubly bowed construction in which the posterior handle section has a relatively longer, generally straight intermediate handle section bowed upwardly from the front handle section, and a generally straight rear section bowed upwardly from the rear portion of the intermediate handle section, the rear handle section being of approximately the same length as the intermediate handle section.

DESCRIPTION OF THE PREFERRED EMBODIMENTS

Figure 1:
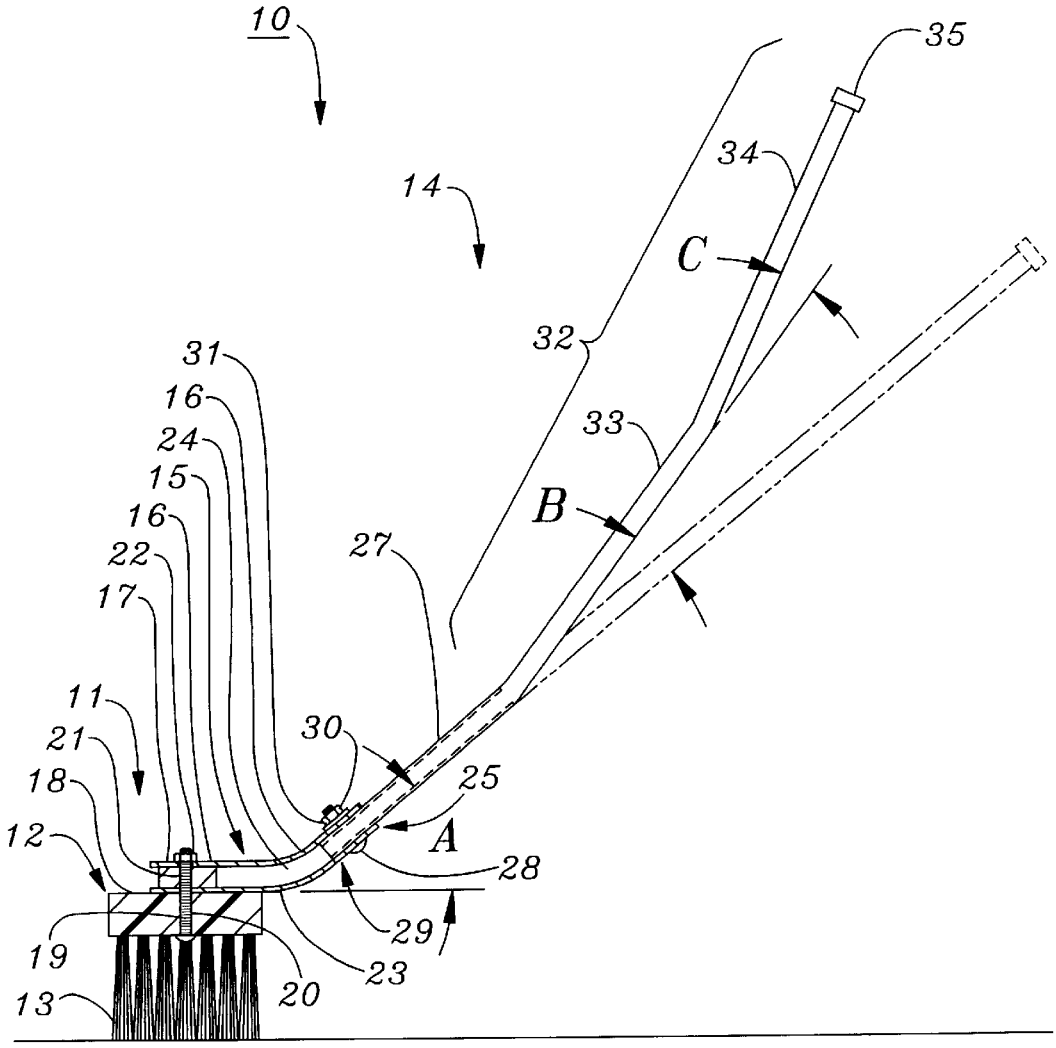
FIG. 1 is a side elevation view of a push broom with a doubly bowed handle according to the present invention, showing the configuration of a prior art broom handle in dashed lines for comparison.

FIG. 1 illustrates a push broom having a doubly bowed handle according to the present invention.

Referring to FIG. 1, a push broom 10 having a doubly bowed handle according to the present invention may be seen to included a front working portion or brush head 11 which has a brush block 12 provided with downwardly depending brush bristles 13. As shown in FIG. 1, brush head 11 may be of conventional design, in which brush block 12 has a laterally elongated, generally rectangular plan-view shape. Bristles 13, which may be made of conventional brush bristle materials such as straw, other natural fibers, synthetic polymer fibers, or other such fibrous materials, are conventionally arrayed in a plurality of rows disposed along brush block 12 in a direction transverse to the intended sweeping direction of broom 10. As shown in FIG. 1, brush block 12 of broom 10 includes means for attaching an elongated handle 14 to the upper side of the brush block. The attachment means 15 may be of conventional design, including a clamp 16 having a front laterally elongated front flange section 17 attached to the upper surface 18 of brush block 12 by means of a bolt 19 which protrudes upwards through a bore 20 provided through the thickness dimension of the brush block, and through a hole 21 provided through the front flange section, the bolt being secured by a threaded fastener such as a wing nut 22 tightened down on the upper surface of the front flange section.

As shown in FIG. 1, clamp 16 includes a tapered tubular rear section 23 which angles upwardly and rearwardly from the upper surface 18 of brush block 12. Tubular rear clamp section 23 has a tapered circular bore 24 having a rear opening 25 adapted to receive the front end of a front handle section 27 of a handle 14. Front handle section 27 of handle 14 may be secured in bore 24 of rear tubular clamp section 23 by any conventional means, such as by a bolt 28 passed through holes 29 through the walls of the tubular clamp section and a hole 30 through the front end of the front handle section, the bolt being secured by a nut 31.

Referring still to FIG. 1, it may be seen that the longitudinal axis of rear tubular clamp section 23, and therefore the longitudinal axis of front end 27 of handle 14, since the two axes are coaxial, are inclined at an angle of about 50 degrees to a vertical line through brush block 12, i.e., at an angle A of about 40 degrees to the horizontal footprint of brush bristles 13.

As shown in FIG. 1, handle 14 is of generally uniform transverse cross section, preferably circular. Although handle 14 may be made of any suitably strong, rigid material such as solid wood or hollow steel tubing, the handle is preferably made of aluminum tubing. While the precise dimensions of the tubing from which handle 14 is fabricated are not critical, in an example embodiment tested and found suitable by the present inventors, handle 14 was made of aluminum tubing having an outer diameter of 1⅜ inches and an inner diameter of 1⅛ inches.

Referring still to FIG. 1, handle 14 of broom 10 may be seen to be doubly bowed. Thus, as shown in FIG. 1, handle 14 has a front relative short straight section 27, and a posterior section 32 which is bent or bowed upwards from front handle section 27. As will be made clear in the ensuing description, posterior section 32 of handle 14 may be made straight and still provide advantages of the novel design of broom 10 over the prior art. However, in the preferred embodiment of broom 10, posterior section 32 of handle 14 is also upwardly bowed. Thus, as shown in FIG. 1, posterior section 32 of handle 14 of broom 10 includes an intermediate section 33 which bows upwardly from front handle section 27, and a rear section 34 which bows upwardly from the rear end of the intermediate handle section.

In an example embodiment of broom 10, front handle section 27 was inclined downwardly at an angle of about 50 degrees to a vertical line perpendicular to upper surface 18 of brush block 12. With this inclination, the longitudinal axis of the front handle section is inclined at an angle A of about 40 degrees upwardly from upper surface 18 of brush block 12, and from a horizontal sweeping surface contacted perpendicularly by the tips of brush bristles 13. Also in the example embodiment of broom 10, intermediate section 33 of handle 14 was bowed or inclined upward at an angle B of about 14 degrees with respect to front handle section 27, and rear section 34 was bowed or inclined upward at an angle C of about 12 degrees with respect to intermediate handle section 33. Thus, in the example embodiment of broom 10, rear handle section 34 was inclined upwards at an angle of 14 degrees plus 12 degrees, or 26 degrees with respect to front handle section 27. Therefore, since front handle section is inclined upwards at an angle of 90 degrees minus 50 degrees or 40 degrees from the horizontal upper surface 18 of brush block 12, rear handle section 34 is angled upwards from the horizontal at an angle of about 40 degrees plus 26 degrees, or 66 degrees, rather than the 40 degree angle of a typical prior art broom. With this more nearly vertical orientation of rear handle section 34, the handle may be grasped by the two hands of a person using broom 10 with the fingers and thumbs wrapped around the more nearly vertically disposed handle section, and the wrists oriented in a relaxed, generally non-rotated position, as shown in FIG. 4. This is in contrast to the position of the hands relative to the handle of a prior art broom as shown in FIG. 3, in which the thumbs must typically be oriented generally parallel to the longitudinal axis of the broom handle, in a much less comfortable and effective grasping conformation.

Figure 3:
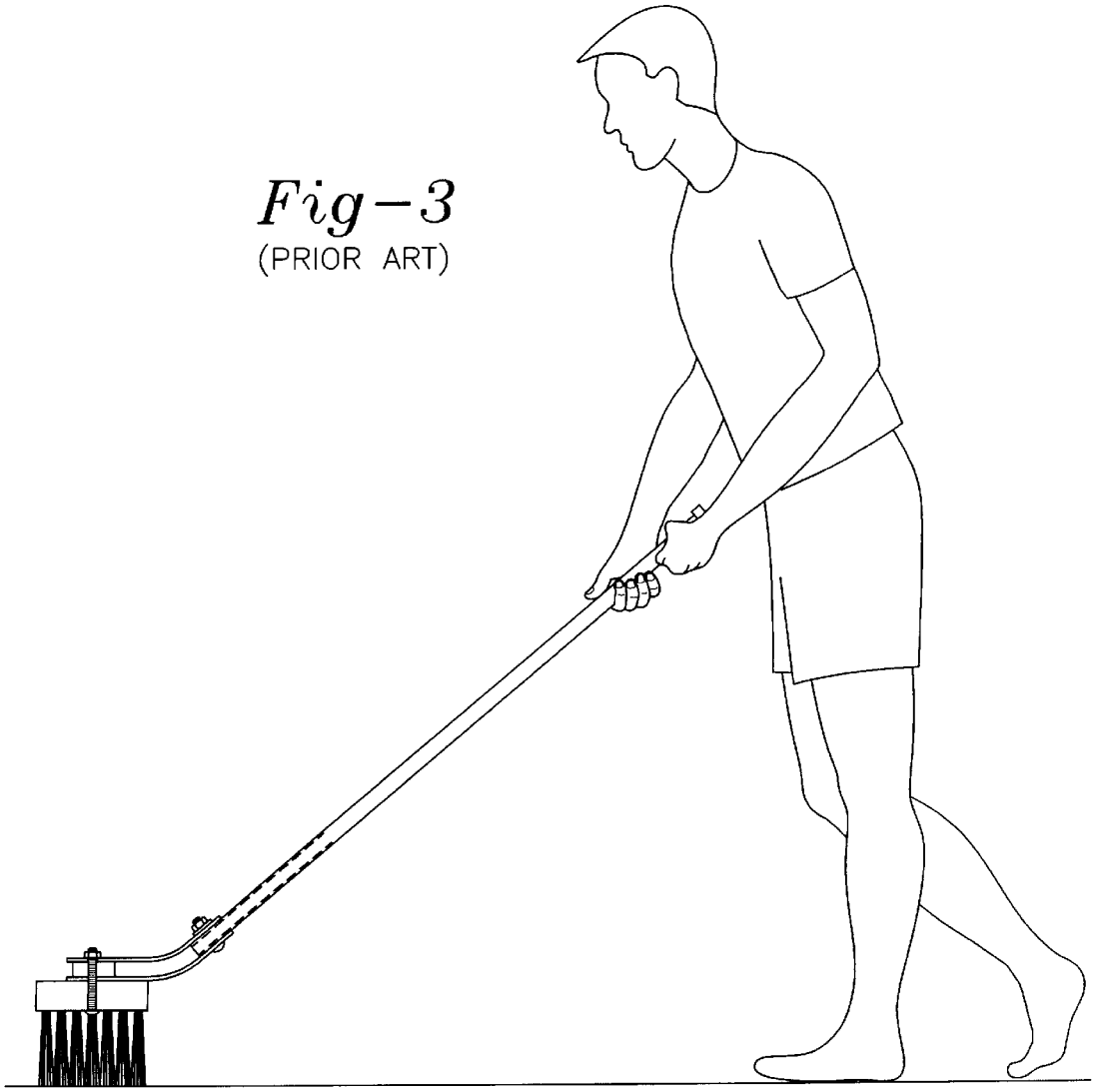
Fig-3 (PRIOR ART)
FIG. 3 is a perspective view showing a prior art push broom in use.
Figure 4:
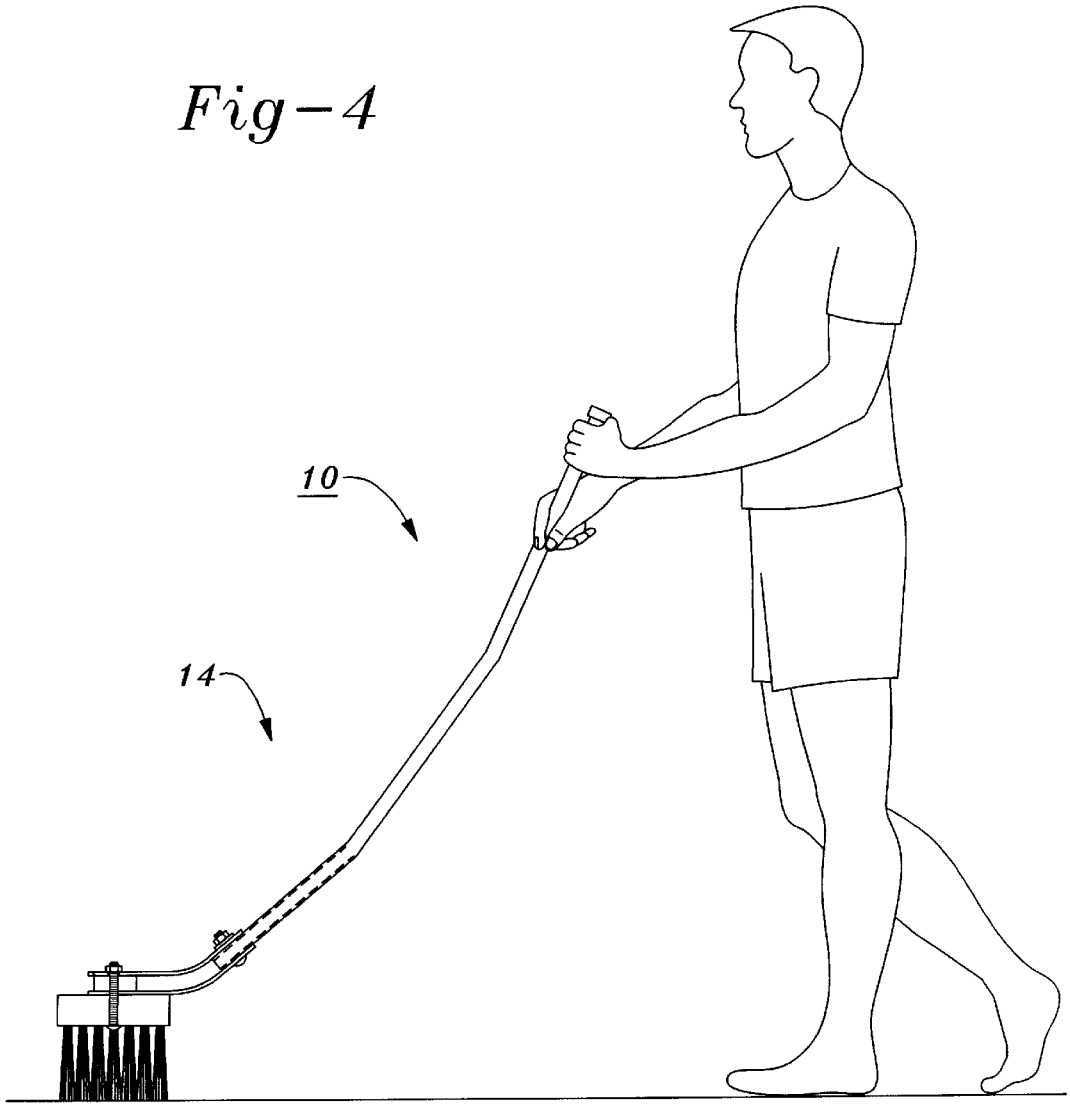
FIG. 4 is a perspective view showing the push broom of FIG. 1 in use.

Moreover, with the upper or rear handle section 34 of broom 10 oriented in a more nearly vertical direction, as shown in FIG. 4, thrust forces exerted by the broom user may be substantially in a horizontal direction, rather then directly downwardly along the longitudinal axis of the handle, as with prior art brooms as shown in FIG. 3. Thus, the force exerted by a user of broom 10 according to the present invention is more efficiently used, since a substantially smaller component of the force is directed in a downwardly oriented direction which does not aid in sweeping debris.

Although the exact dimensions of broom 10 according to the present invention are not critical, in an example embodiment of the broom, front handle section 27 had a length of about 14 inches, intermediate handle section 33 had a length of about 19 inches, and rear handle section 34 had a length of about 21 inches, for a total handle length of about 54 inches.

As shown in FIG. 1, a protective polymer end cap 35 is preferably fitted over the upper end of handle section 34.

Figure 2A:
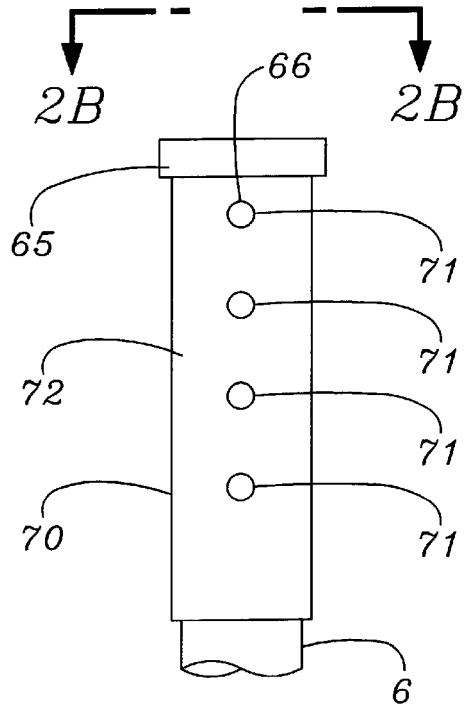
FIG. 2A is an elevational view of a modification of an upper end portion of the handle of the broom shown in FIG. 1.
Figure 2B:
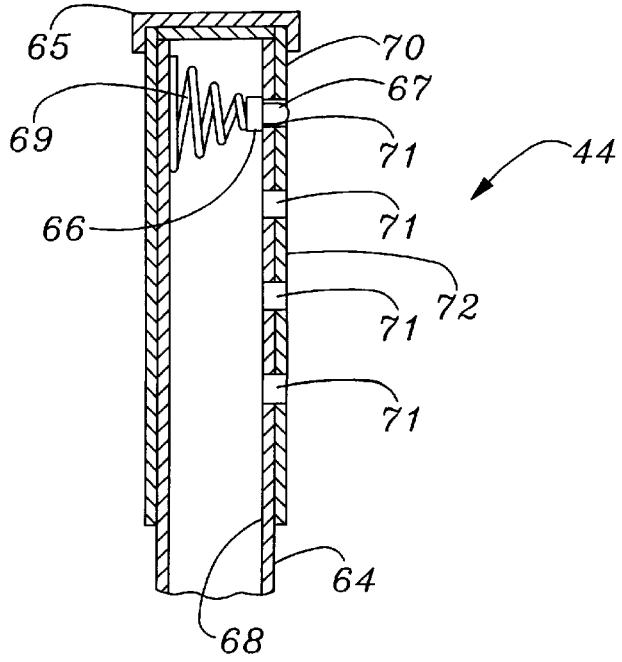
FIG. 2B is a longitudinal section view of the modification of FIG. 2A, taken along line 2B—2B.

FIGS. 2A and 2B illustrate a modification of handle 14 of broom 10. In this modification, the length of handle 14 may be individually adjusted to suit the height and preferences of the user of broom 10.

As shown in FIGS. 2A and 2B, modified handle 44 has a rear handle section 64 which is telescopically adjustable to a desired length. Thus, as shown in FIG. 2B, the upper or rear end of tubular rear handle section 64 is provided with a radially movable, flanged detent button 66, which is urged radially outwards through a bore 67 provided through cylindrical side wall 68 of the rear handle section, by a spring 69. A tubular hand grip extension 70 fits coaxially slidably over an outer longitudinal end portion of rear handle section 64. A plurality of longitudinally spaced apart and aligned, radially disposed detent holes 71 are provided through cylindrical wall 72 of hand grip extension 70. The detent holes are of slightly larger diameter than detent button 66, and are adapted to insertably receive the detent button. With this arrangement, tubular hand grip extension 70 may be slipped coaxially over rear handle section 64, and slid to a desired longitudinal location, where detent button 66 is urged radially outwards to protrude through a selected detent hole 71. By this means, the overall length of the upper portion of handle 44 may be adjusted to a desired value. Preferably, the outer end of tubular hand grip section 70 is fitted with a protective polymer end cap 65.

In a modification of the adjustable length handle 44 described above, the front portion of the handle could be made telescopically engageable with the tubular brush block clamp, to allow length adjustment of the front portion of the handle rather than the rear portion.

What is claimed is:

1. A tool for working a ground surface by pushing said tool by hand across said ground surface, said tool comprising:

a. laterally disposed block having a planar upper surface and a ground working element downwardly depending from a bottom surface, b. a handle connecting member secured to the upper surface of the block, the connecting member including a first portion extending along and substantially parallel to said upper surface and a second angled portion which defines an acute angle with respect to the plane of the upper surface, c. an elongated handle which is coupled to said connecting member such that it extends generally upwardly and rearwardly with respect to the upper surface of the block, said handle comprising, (i) an elongated front handle portion, the axis of the front handle portion being aligned with the second angled portion of the connecting member such that it extends upwardly and rearwardly with respect to said upper surface and defines a first angle with respect to the plane of the upper surface, (ii) an elongated intermediate handle portion extending upwardly and rearwardly from the front handle portion, the axis of the intermediate handle portion defining a second angle with respect to the axis of the front handle portion, said second angle being less than said first angle, and (iii) an elongated rear handle portion extending upwardly and rearwardly from the intermediate handle portion, the axis of the rear handle portion defining a third angle with respect to the axis of the intermediate handle portion which is less than said second angle, the axis of the rear handle portion also defining an angle with respect to the plane of said upper surface which is greater than said first angle.

2. The tool of claim 1 wherein said acute angle defined between said angled portion of said connecting member and said upper surface of said block is about 40 degrees.

3. The tool of claim 2 wherein said second angle defined between said elongated intermediate handle portion and said first handle portion is about 14 degrees.

4. The handle of claim 3 wherein said third angle is further defined as being about 12 degrees.

5. A push broom comprising:

(a) a laterally disposed brush block having a planar upper surface and a plurality of bristles downwardly depending from a bottom surface;

(b) a handle connecting member secured to the upper surface of the brush block, the connecting member including a first portion extending along and substantially parallel to said upper surface and a second angled portion which defines an acute angle with respect to the plane of the upper surface; and (c) an elongated handle which is coupled to said connecting member such that it extends generally upwardly and rearwardly with respect to the upper surface of the brush block, said handle comprising, (I) an elongated front handle portion, the axis of the front handle portion being aligned with the second angled portion of the connecting member such that it extends upwardly and rearwardly with respect to said upper surface and defines a first angle with respect to the plane of the upper surface;

(ii) an elongated intermediate handle portion extending upwardly and rearwardly from the front handle portion, the axis of the intermediate handle portion defining a second angle with respect to the axis of the front handle portion, said second angle being less than said first angle; and (iii) an elongated rear handle portion extending upwardly and rearwardly from the intermediate handle portion, the axis of the rear handle portion defining a third angle with respect to the axis of the intermediate handle portion which is less than said second angle, the axis of the rear handle portion also defining an angle with respect to the plane of the said upper surface which is greater than said first angle.

6. The push broom of claim 5 wherein said acute angle defined between said second angled portion of said connecting member and said upper surface of said brush block is about 40 degrees.

7. The push broom of claim 5 wherein said second angle defined between said elongated intermediate handle portion and said front handle portion is about 14 degrees.

8. The push broom of claim 5 wherein said third angle defined between said elongated rear handle portion and said intermediate handle portion is about 12 degrees.

9. The push broom of claim 5 wherein said elongated handle is further defined as lying in a vertical plane perpendicular to a horizontal plane defining the lower edges of said bristles.

10. The push broom of claim 9 wherein said vertical plane containing said handle is further defined as being a medial plane of said brush block.

11. The push broom of claim 5 wherein said handle is further defined as having a generally uniform transverse cross section.

12. The push broom of claim 5 wherein said handle is further defined as having a telescopic adjustable rear end handle portion.

13. The push broom of claim 5 wherein said handle is further defined as being of generally tubular construction.

* * * * *